US006386490B1

(12) United States Patent
Suh

(10) Patent No.: US 6,386,490 B1
(45) Date of Patent: May 14, 2002

(54) STROLLER ADJUSTABLE HOLDER

(76) Inventor: Simon Suh, 2007 Raymer Ave., Suite S, Fullerton, CA (US) 92833

( * ) Notice: Subject to any disclaimer, the term of this patent is extended or adjusted under 35 U.S.C. 154(b) by 0 days.

(21) Appl. No.: 09/648,419

(22) Filed: Aug. 28, 2000

(51) Int. Cl.[7] ..... A47D 15/00

(52) U.S. Cl. ..... 248/104; 248/102; 248/103; 248/105; 248/106; 248/107

(58) Field of Search ..... 248/104, 103, 248/102, 105, 106, 107

(56) References Cited

U.S. PATENT DOCUMENTS

| | | | | | |
|---|---|---|---|---|---|
| 2,182,164 | A | * | 12/1939 | Rosenberg | 248/104 |
| 2,359,452 | A | * | 10/1944 | Summers | 248/104 |
| 2,399,320 | A | * | 4/1946 | Brose et al. | 248/104 |
| 2,428,724 | A | * | 10/1947 | Stretz | 248/104 |
| 2,462,187 | A | * | 2/1949 | Helixon | 248/104 |
| 2,470,379 | A | * | 5/1949 | Swaim | 248/104 |
| 2,518,862 | A | * | 8/1950 | Cain et al. | 248/104 |
| 2,545,414 | A | * | 3/1951 | Pittman | 248/104 |
| 2,681,782 | A | * | 6/1954 | Morishita | 248/106 |
| 2,841,349 | A | * | 7/1958 | Charles | 248/104 |
| 3,151,828 | A | * | 10/1964 | Alloy | 248/104 |
| 4,482,117 | A | * | 11/1984 | Besek, Jr. | 248/103 |
| 5,135,189 | A | | 8/1992 | Ghazizadeh | 248/104 |
| 5,192,041 | A | | 3/1993 | Bryant | 248/104 |
| 5,489,075 | A | | 2/1996 | Ible | 248/104 |
| 5,664,746 | A | | 9/1997 | Benzakarya | 248/106 |
| 5,873,551 | A | | 2/1999 | Jones | 248/102 |
| 6,003,821 | A | | 12/1999 | Fabian et al. | 248/104 |

* cited by examiner

*Primary Examiner*—Anita King
*Assistant Examiner*—Kofi A Schulterbrandt
(74) *Attorney, Agent, or Firm*—John K. Park; Park & Sutton LLP

(57) ABSTRACT

The stroller adjustable holder includes a frame member having a tip, a middle portion, a center axis, a first side and a second side. A first connection clip and a second connection clip are attached to the frame member. A gripping member is attached to the tip. The first side and the second side are flexible and substantially symmetrical about the center axis. The first side and the second side are joined at the tip and radially extend out in substantially a "V" shape. The first connection clip and the second connection clip attach to a baby stroller. The gripping member can take various forms that allows the gripping member to accept an object. The object can be a toy, baby bottle or any other object that nurtures, entertains or distracts the baby. The gripping member can be an adjustable baby bottle holder with three directions of movement provide by a rotating member and a grasping member.

13 Claims, 4 Drawing Sheets

STROLLER ADJUSTABLE HOLDER

BACKGROUND

The present invention relates to an adjustable holder for use on a stroller. The stroller adjustable holder is used for holding a toy, baby bottle or other object in close proximity to the baby. The stroller adjustable holder provides hands free feeding or entertainment of an infant. More particularly, the present invention pertains to devices that are attached to strollers that allow the toy or baby bottle to remain in or near the baby's hands or mouth without the continuous assistance of an attendant.

Most of the prior art devices are restricted in some direction of their movement and many are not designed to be attached to a baby stroller. Unfortunately, the prior art devices typically are designed to be positioned by an adult, but they are not flexible enough with minimal friction to move with the child's mouth or hands.

Flexible arms are often used to position the bottle near the child. The flexible arms must be rigid enough to hold the weight of the bottle or toy, as such, they are often too rigid to allow a young baby to move the bottle or toy by themselves just by the strength of their own head or hard movement.

The prior art devices show that there is a need for a stroller adjustable holder that will hold varying objects in close proximity to a child. Additionally, when the object is a baby bottle the holder needs to be movable in conformance with the head movements of the baby.

SUMMARY

An objective of the present invention, a stroller adjustable holder, is creating a device that will hold varying objects in close proximity to a child.

An additional objective of the stroller adjustable holder is the holding an adjustable baby bottle holder, which provides multiple directions of low resistance movement. The movement by the baby bottle holder in multiple spatial directions allows the bottle to remain in the baby's mouth despite head movement by the baby. Directions of head movement side-to-side, up and down, or forward and backward can all be accommodated.

The stroller adjustable holder includes a frame member having a tip, a middle portion, a center axis, a first side and a second side. A first connection clip and a second connection clip are attached to the frame member. A gripping member is attached to the tip.

The first side and the second side are flexible and substantially symmetrical about the center axis. The first side and the second side are joined at the tip and radially extend out in substantially a "V" shape. The first connection clip and the second connection clip attach to a baby stroller. The gripping member can take various forms that allows the gripping member to accept an object. The object can be a toy, baby bottle or any other object that nurtures, entertains or distracts the baby.

The first side and the second side vary a distance "d" from the center axis. In one version when the first side and the second side are in an unrestrained state the distance "d" is about 0 at about the tip, "d" can gradually increase throughout the middle portion, then "d" can slightly decrease at about the first connection clip and the second connection clip. Alternate configurations of the distance "d" are readily apparent. The flexibility of the first side and the second side allow the distance "d" to be expanded by pulling on the first side and the second side.

A universal attachment can be attached to the tip. Alternately, an extension can be attached to the tip with the extension accepting the universal attachment. An arm member having an attachment end and a joint end attaches to the universal attachment. The gripping member is attached to the joint end of the arm member and the attachment end of the arm member is attached to the universal attachment. In this arrangement the first side and the second side are joined at the tip. Attached to the tip, in sequence, are the extension, universal attachment, arm member, and gripping member. The arm member can be rigid or a flexible arm member. Flexibility allows the flexible arm member and the gripping member to be movably positioned.

When the gripping member holds a toy the flexible arm member can be moved to position the toy near the baby's hands. If the gripping member holds a baby bottle the flexible arm member can be moved to position the baby bottle closer to the baby's mouth.

The first connection clip and the second connection clip can be snap on clips forming an open cylinder. The first connection clip and the second connection clip may take other configurations that adapt to connection to the parts of a baby stroller.

In an unrestrained position the distance "d" is about 2 to 5 inches at about the first connection clip and at about the second connection clip. The first side and the second side are sufficiently flexible, such that the distance "d" can be increased by pulling on the first side and the second side, such that the stroller adjustable holder will accommodate baby stroller handles of varying separation widths.

The gripping member can be an adjustable baby bottle holder. A first grasping member can hold a baby bottle and the flexible arm member can be secured at the attachment end to the tip or universal attachment.

The adjustable baby bottle holder can be attached to the flexible arm member having an attachment end and a joint end. A rotating member is rotatably attached to the joint end of the flexible arm. The rotating member has a horizontal axis, a vertical axis, a bottom bar, a top bar, a front end and a back end. An embodiment of the adjustable baby bottle holder is constructed with the bottom bar and top bar being substantially cylindrical in shape. The rotating member takes the form of the perimeter of a rectangle. The first grasping member is attached to the rotating member.

The rotating member rotates about the vertical axis providing a first direction of movement. A second direction of flexible movement is also available where the first grasping member rotates circumferentially about the horizontal axis of the rotating member. A third direction of movement is provided with the first grasping member being slidably attached to the bottom bar of the rotating member.

The first grasping member is designed to hold a baby bottle. The flexible arm can be secured at the attachment end, then moved and positioned such that the baby bottle is near the mouth of the baby. The baby bottle can move with the baby and remain in the baby's mouth since the rotating member rotates about the vertical axis.

A second direction of flexible movement is also available with the first grasping member rotatably attached to the rotating member. The first grasping member rotates circumferentially about the horizontal axis of the rotating member. When the baby is sitting upright and rocks her head side to side, then this circumferential rotation keeps the bottle in contact with the baby's mouth.

In one embodiment the bottom bar is a cylindrical shape. The first grasping member is slidably attached to the bottom bar of the rotating member by a force fit snap-on mechanism that allows movement back and forth between the back end and the front end of the rotating member. The sliding movement is along the horizontal axis. The force fit snap-on mechanism allows the first grasping member to perform the circumferential rotation, as well as the sliding movement.

The first grasping member has one or more fingers that are a semicircle shape about the same diameter as the bottle that the first grasping member is designed to hold. The fingers of the first grasping member clasp about the baby bottle. The snap-on mechanism is designed so that the first grasping member is removably attached to the rotating member. The first grasping member may be interchanged with a second grasping member that has fingers that are of differing diameter than the first grasping member, such that different size baby bottles can be held.

With the adjustable arm member the bottle can easily be tilted upward to prevent leaking of fluids from the nipple. This advantage applies when the baby is taking a short break from feeding so the bottle is temporarily not in use. The feature is also advantageous when the baby falls asleep while feeding where the bottle will remain generally in its established position and not lay nipple pointed downward prone to leaking.

The following drawings and description of the drawings provide greater specificity and detail of the elements of the invention.

DESCRIPTION

Figure 1:
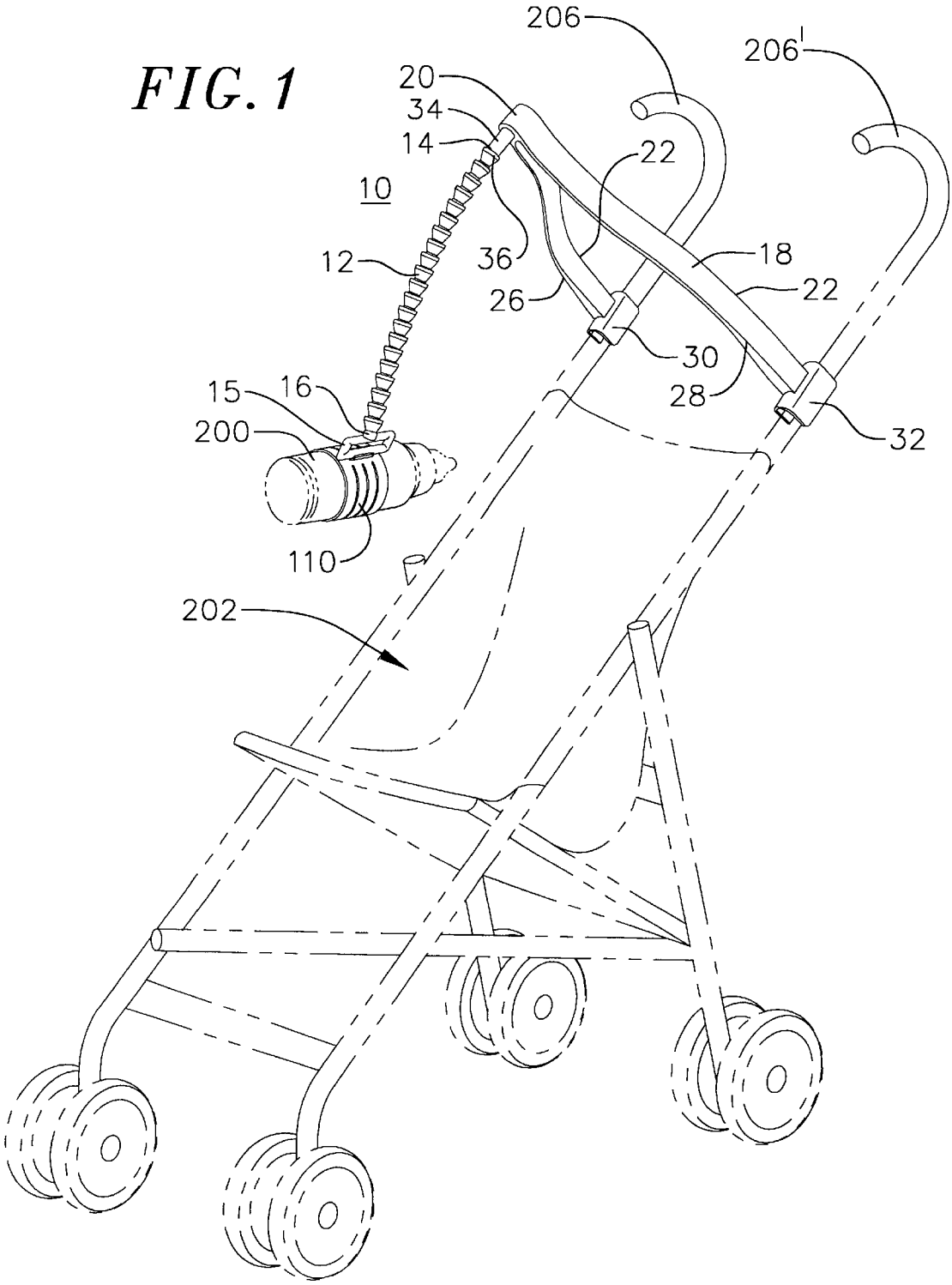
FIG. 1 is a perspective view of the stroller adjustable holder.

Referring to FIGS. 1–6; the stroller adjustable holder 10 includes a frame member 18 having a tip 20, a middle portion 22, a center axis 24, a first side 26 and a second side 28. A first connection clip 30 and a second connection clip 32 are attached to the frame member 18. Attached to the tip 20 are an extension 34 with a universal attachment 36, a flexible arm member 12 having an attachment end 14 and a joint end 16, and a gripping member 15 attached to the joint end 16. In a simpler version the gripping member 15 can be attached directly to the tip 20.

The first side 26 and the second side 28 are flexible and substantially symmetrical about the center axis 24. The first side 26 and the second side 28 are joined at the tip 20 and radially extend out in substantially a "V" shape. The first connection clip 30 and the second connection clip 32 attach to a baby stroller 202.

Figure 3:
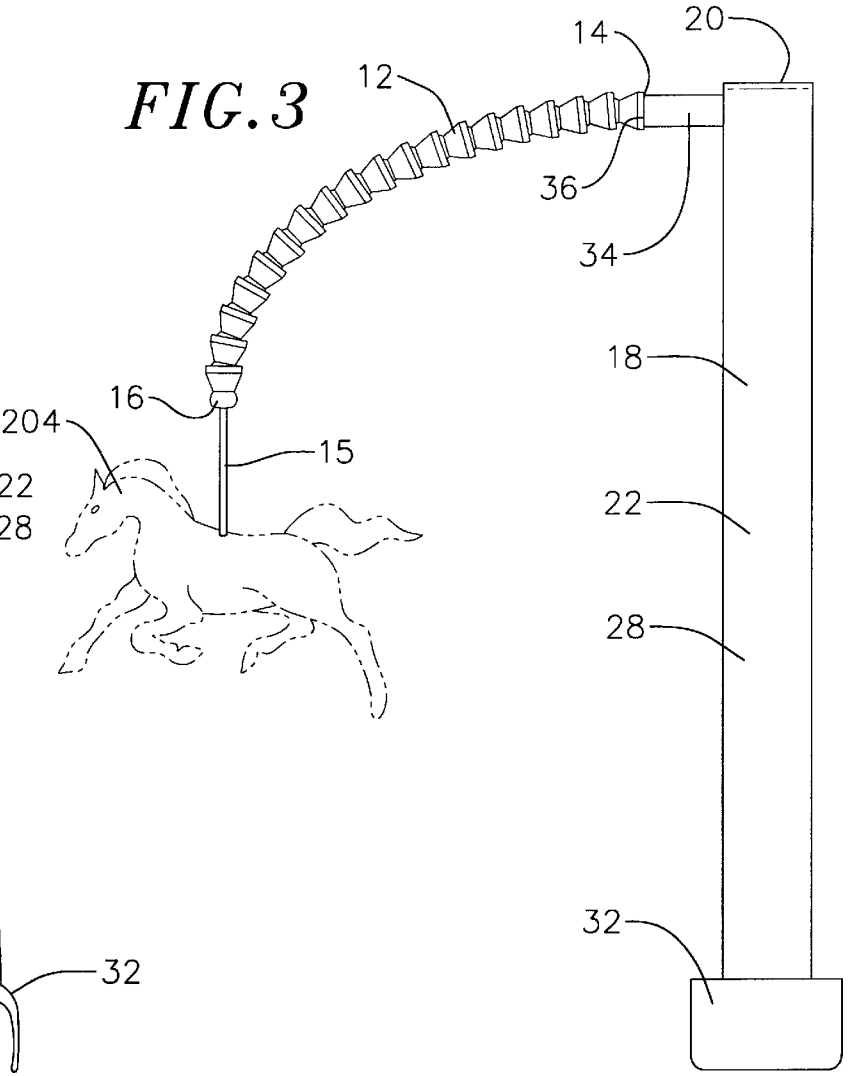
FIG. 3 is a side view.

The gripping member 15 can take various forms that allow the gripping member 15 to accept an object. FIG. 3 illustrates the gripping member 15 as a cord holding a toy 204. The object can be a toy 204, baby bottle 200 or any other object that nurtures, entertains or distracts the baby.

Figure 2:
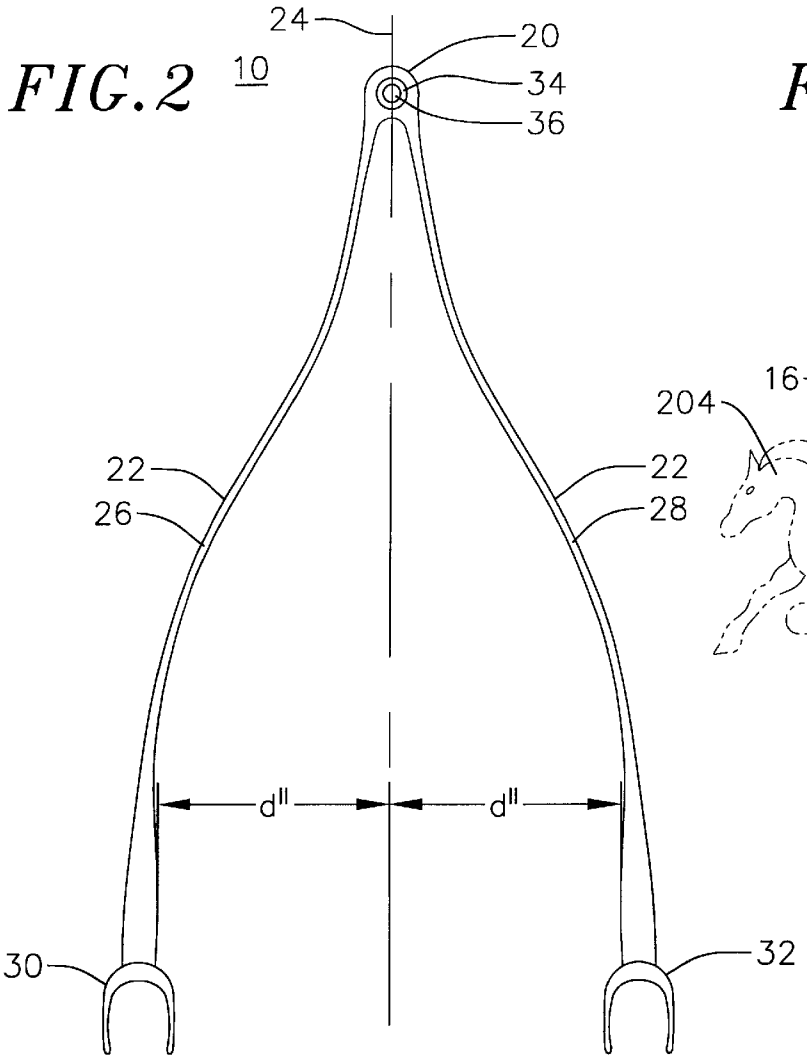
FIG. 2 is a front view.

Referring to FIG. 2; the first side 26 and the second side 28 each vary a distance "d" from the center axis 24. In one version when the first side 26 and the second side 28 are in an unrestrained state the distance "d" is about 0 at about the tip 20, "d" gradually increases throughout the middle portion 22, then "d" slightly decreases at about the first connection clip 30 and the second connection clip 32. Alternate configurations of the distance "d" are readily apparent. The flexibility of the first side 26 and the second side 28 allow the distance "d" to be expanded by pulling on the first side 26 and the second side 28.

A universal attachment 36 can be attached to the tip 20. An extension 34 is shown attached to the tip 20. The extension 34 accepts the universal attachment 36. Attached to the universal attachment 36 is the arm member 12 having an attachment end 14 and a joint end 16.

The gripping member 15 is attached to the joint end 16 of the arm member 15 and the attachment end 14 of the arm member 15 is attached to the universal attachment 36. In this arrangement the first side 26 and the second side 28 are joined at the tip 20, attached to the tip 20 in sequence are the extension 34, universal attachment 36, arm member 12, and gripping member 15. The arm member 12 can be rigid or a flexible arm member 12. Flexibility allows the flexible arm member 12 and the gripping member 15 to be movably positioned.

When the gripping member 15 holds a toy 204 the flexible arm member 12 can be moved to position the toy 204 near the baby's hands. If the gripping member 15 holds a baby bottle 200 the flexible arm member 12 can be moved to position the baby bottle 200 closer to the baby's mouth.

The first connection clip 30 and the second connection clip 32 are snap on clips forming an open cylinder. The first connection clip 30 and the second connection clip 32 may take other configurations that adapt for connection to the parts of a baby stroller 202.

In an unrestrained position the distance "d" is about three (3) inches at about the first connection clip 30 and about the second connection clip 32. The first side 26 and the second side 28 are sufficiently flexible, such that the distance "d" can be increased by pulling on the first side 26 and the second side 28, such that the stroller adjustable holder 10 will accommodate baby stroller handles 206, 206' of varying separation widths.

Figure 4:
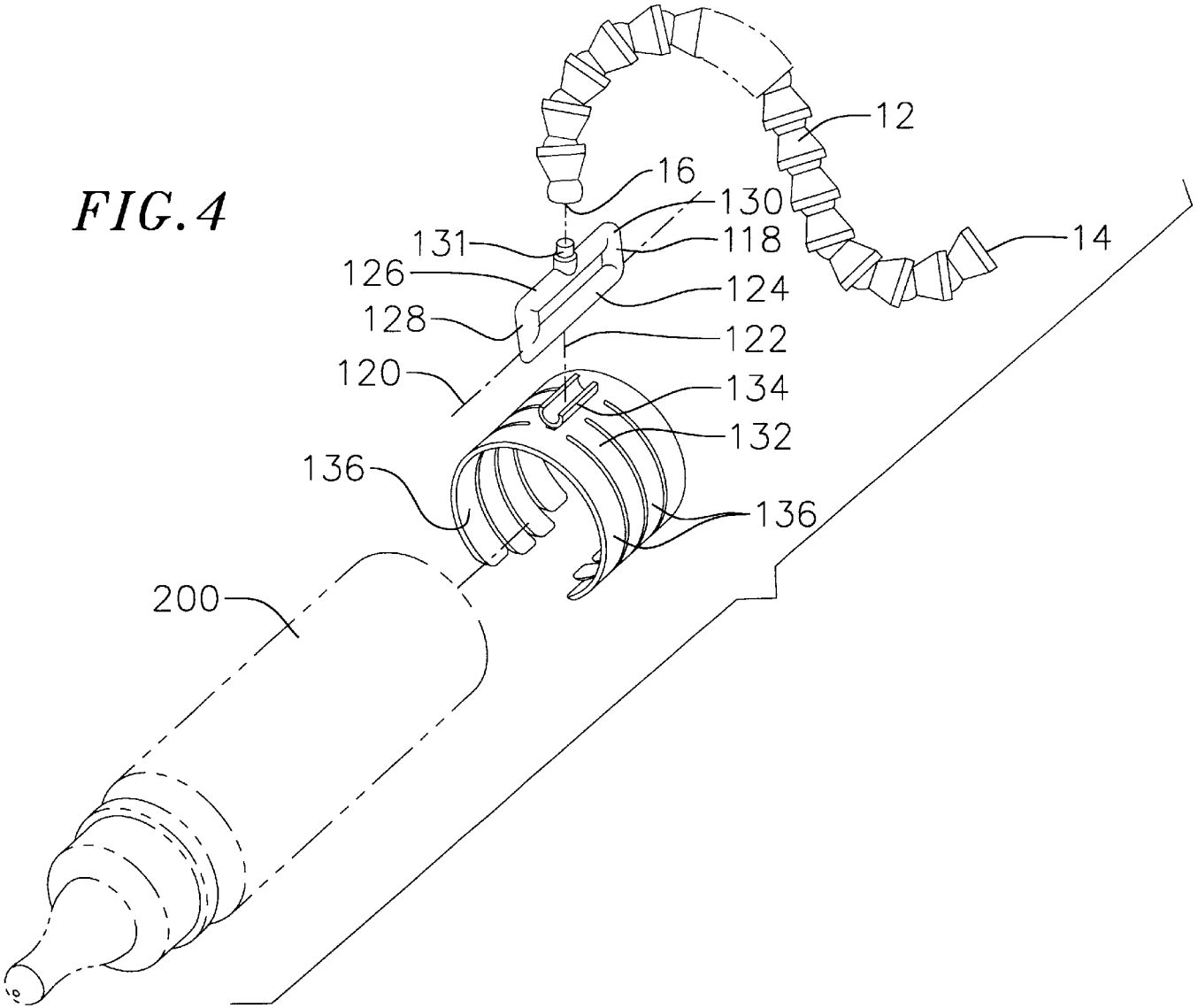
FIG. 4 is an exploded perspective view of the flexible arm and adjustable baby bottle holder.
Figure 6:
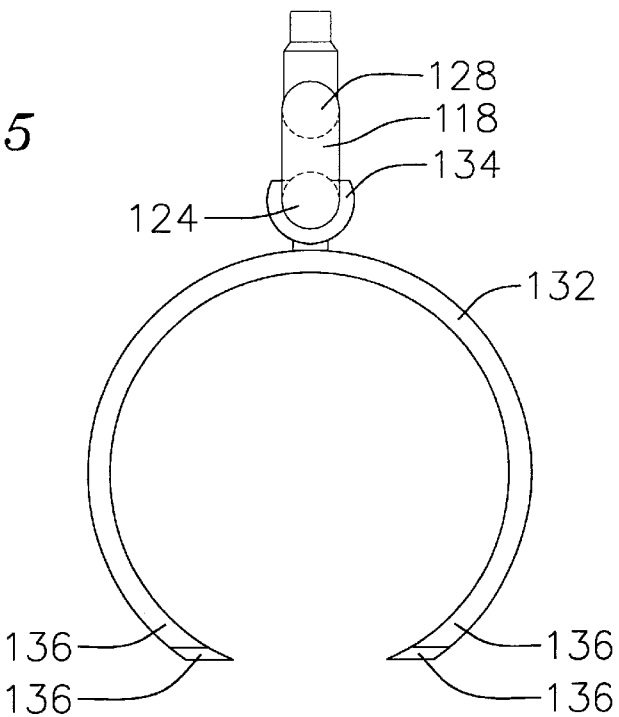
FIG. 6 is a front view of the first grasping member and rotating member of the adjustable baby bottle holder.
Figure 5:
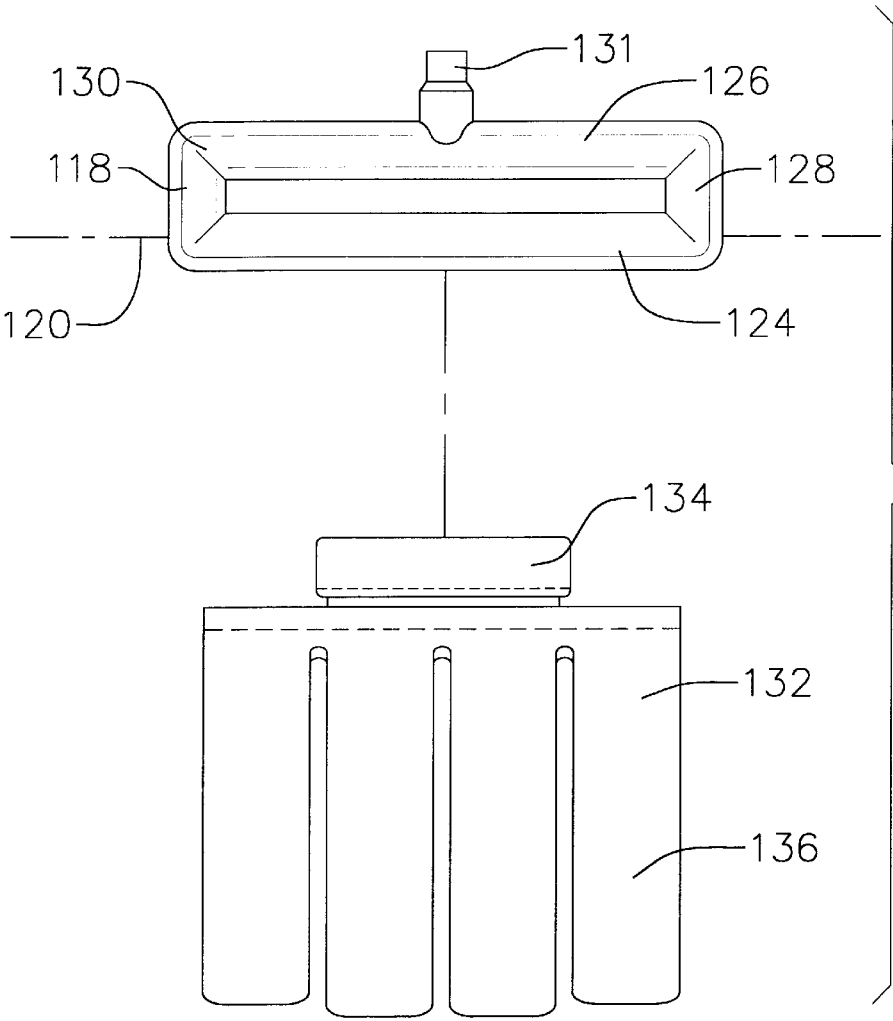
FIG. 5 is an exploded side view of the first grasping member and rotating member of the adjustable baby bottle holder.

FIGS. 4, 5, 6 show in detail the gripping member 15 as an adjustable baby bottle holder 110. A first grasping member 132 can hold a baby bottle 200 and the flexible arm member 12 can be secured at the attachment end 14 to the tip 20 or universal attachment 36.

An adjustable baby bottle holder 110 includes a flexible arm member 12 having an attachment end 14 and a joint end 16. A rotating member 118 is rotatably attached to the joint end 16 of the flexible arm member 12. The rotating member 118 has a horizontal axis 120, a vertical axis 122, a bottom bar 124, a top bar 126, a front end 128, a back end 130 and a nodule 131. The nodule 131 snaps into the joint end 16 of the rotating member 118. The nodule 131 is located on the top bar 126.

An embodiment of the present invention is constructed with the bottom bar 124 and top bar 126 being substantially cylindrical in shape. The rotating member 118 takes the form of the perimeter of a rectangle. The first grasping member 132 is attached to the rotating member 118.

The rotating member 118 rotates about the vertical axis 122. The first grasping member 132 is designed to hold a baby bottle 200. The flexible arm member 12 can be secured at the attachment end 14 to an object, such as a baby crib, or stroller then moved and positioned such that the baby bottle 200 is near the mouth of the baby. The baby bottle 200 can move with the baby and remain in the baby's mouth since the rotating member 118 rotates about the vertical axis 122.

A second direction of flexible movement is also available with the first grasping member 132 rotatably attached to the rotating member 118. The first grasping member 132 rotates circumferentially about the horizontal axis 120 of the rotating member 118. When the baby is sitting upright and rocks her head side to side this circumferential rotation keeps the baby bottle 200 in contact with the baby's mouth.

In one embodiment the bottom bar 124 is a cylindrical shape. The first grasping member 132 has a force fit snap-on mechanism 134. The first grasping member 132 is slidably attached to the bottom bar 124 of the rotating member 118 by the force fit snap-on mechanism 134 that allows movement back and forth between the back-end 130 and the front end 128 of the rotating member 118. Also, the force fit snap-on mechanism 134 allows the first grasping member 132 to perform the circumferential rotation movement, as well as the sliding movement.

Directional arrows indicate the three directions of movement; first is rotation about the vertical axis 122, second is circumferential rotation about the horizontal axis 120 and third is back and forth movement along the horizontal axis 120.

The first grasping member 132 has one or more fingers 136 that are a semicircle shape about the same diameter as the bottle 200 that the first grasping member 132 is designed to hold. The fingers 136 of the first grasping member 132 clasp about the baby bottle 200. The snap-on mechanism 134 is designed so that the first grasping member 132 is removably attached to the rotating member 118.

Although not illustrated, the first grasping member 132 may be interchanged with a second grasping member that has fingers that are of differing diameter than the first grasping member 132, such that different size baby bottles 200 can be held.

The stroller adjustable holder 10 can be formed from plastic, aluminum, fiberglass or other flexible materials. The flexibility of the stroller adjustable holder 10 allows the invention to be attached to baby strollers 202 of varying size and dimension.

The stroller adjustable holder 10 includes a frame member 18 that forms substantially a "V" or wishbone shape, which is narrow at one end and wide at the other end. The first side 26 and second side 28 join at the tip 20 then gradually the distance "d" between the first side 26 and second side 28 increases. A first connection clip 30 and second connection clip 32 attach to the first side 26 and second side 28. The connection clips 30,32 accept and attach to the frame of a baby stroller 202. The first connection clip 30 and second connection clip 32 slide up and down upon the stroller handles 206, 206' to allow precise positioning of a bottle 200, toy 204 or other object near the baby.

The first side 26 and second side 28 are flexible, which allows them to be pulled apart thus increasing the separation distance between them. Increasing the separation distance allows the invention 10 to be used on strollers 202 of various sizes with differing distances between the stroller handles 206, 206'. Flexiblity also allows the stroller adjustable holder to be folded tightly with the first side 26 and second side 28 secured together for easy storage.

Although the present invention has been described in considerable detail with regard to the preferred versions thereof, other versions are possible. Therefore, the appended claims should not be limited to the descriptions of the preferred versions contained herein.

What is claimed is:

1. A stroller adjustable holder comprising:

(a) a frame member having a tip, a middle portion, a center axis, a first side and a second side;

(b) a first connection clip and a second connection clip attached to the frame member; and c) a gripping member attached to the tip; wherein the first side and the second side are flexible and substantially symmetrical about the center axis; wherein the first side and the second side are joined at the tip and the first side and the second side radially extend out in substantially a "V" shape; whereby the first connection clip and the second connection clip attach to a baby stroller; whereby the gripping member can accept an object;

wherein the first side and the second side vary a distance "d" from the center axis; wherein when the first side and the second side are in an unrestrained state the distance "d" is about 0 at about the tip, "d" gradually increasing throughout the middle portion, then "d" slightly decreasing at about the first connection clip and the second connection clip.

2. The stroller adjustable holder of claim 1 wherein in an unrestrained position the distance "d" is about 3 inches at about the first connection clip and about the second connection clip.

3. The stroller adjustable holder of claim 2;

wherein the first side and the second side are sufficiently flexible, such that the distance "d" can be increased by pulling on the first side and the second side, such that the stroller adjustable holder will accommodate baby stroller handles of varying separation widths.

4. The stroller adjustable holder of claim 3 further comprising:

(a) a universal attachment attached to the tip; and (b) an arm member having an attachment end and a joint end, attached to the universal attachment;

wherein the gripping member is attached to the joint end of the arm member and the attachment end of the arm member is attached to the universal attachment.

5. The stroller adjustable holder of claim 4 wherein the arm member is a flexible arm member;

wherein the flexible arm member and the gripping member can be movably positioned.

6. The stroller adjustable holder of claim 5;

wherein the gripping member accepts a toy.

7. The stroller adjustable holder of claim 6;

wherein the first connection clip and the second connection clip are snap on clips forming an open cylinder.

8. A stroller adjustable holder comprising:

(a) a frame member having a tip, a center axis, a first side and a second side;

(b) a first connection clip and a second connection clip attached to the frame member;

(c) a gripping member attached to the tip;

(d) universal attachment attached to the tip; and (e) an arm member having an attachment end and a joint end, attached to the universal attachment, wherein the arm member is a flexible arm member;

wherein the flexible arm member and the gripping member can be movably positioned;

wherein the first side and the second side are flexible and substantially symmetrical about the center axis;

wherein the first side and the second side are joined at the tip and the first side and the second side radially extend out in substantially a "V" shape, wherein the first connection clip and the second connection clip can attach to a baby stroller and wherein the gripping member can accept an object, wherein the gripping member is attached to the joint end of the arm member and the attachment end of the arm member is attached to the universal attachment;

wherein the gripping member is an adjustable baby bottle holder comprising;

(i) a rotating member rotatably attached to the joint end of the flexible arm member; the rotating member having a horizontal axis, a vertical axis, a bottom bar, a top bar, a front end and a back end; and (ii) a first grasping member rotatably attached to the rotating member;

whereby the rotating member rotates about the vertical axis; whereby the first grasping member rotates circumferentially about the horizontal axis of the rotating member;

whereby the first grasping member can hold a baby bottle; whereby the flexible arm member can be secured at the attachment end to the frame, then moved and positioned.

9. The stroller adjustable holder of claim 8 wherein the bottom bar is a cylindrical shape; whereby the first grasping member is slidably attached to the bottom bar of the rotating member; such that the first grasping member moves between the back end and the front end of the rotating member.

10. The stroller adjustable holder of claim 9 wherein the first grasping member further comprises:

(a) a one or more fingers;

whereby the one or more fingers are a semicircle shape about the same diameter as the bottle which the first grasping member is designed to hold, such that the fingers of the first grasping member clasp about the bottle.

11. The stroller adjustable holder of claim 10, wherein the first grasping member is removably attached to the rotating member such that the first grasping member may be interchanged with a second grasping member having fingers that are of differing diameter than the first grasping member, such that different size baby bottles can be held.

12. The stroller adjustable holder of claim 11, wherein the first grasping member further having a force fit snap-on mechanism; wherein the first grasping member is attached to the rotating member by the force fit snap-on mechanism.

13. The stroller adjustable holder of claim 8;

wherein the first connection clip and the second connection clip are snap on clips forming an open cylinder.

* * * * *